United States Patent [19]

Veit

[11] Patent Number: 4,891,894

[45] Date of Patent: Jan. 9, 1990

[54] COVER SHEET ATTACHMENT FOR A TUNNEL FINISHER PNEUMATIC ROLL

[75] Inventor: Reinhardt Veit, Fuchstal-Seestall, Fed. Rep. of Germany

[73] Assignee: Veit GmbH and Co., Fed. Rep. of Germany

[21] Appl. No.: 198,075

[22] Filed: May 24, 1988

[30] Foreign Application Priority Data

Jun. 29, 1987 [DE] Fed. Rep. of Germany ..... 3721422

[51] Int. Cl.[4] ..... D06F 61/06; D06B 23/16; D06B 23/02

[52] U.S. Cl. ..... 38/66; 38/14; 38/49; 68/5 C; 29/118

[58] Field of Search ..... 68/5 D, 5 C; 34/162; 8/149.3; 38/49, 44, 66, 140, 14; 29/118, 119

[56] References Cited

U.S. PATENT DOCUMENTS

| | | | |
|---|---|---|---|
| 2,172,841 | 9/1939 | Gerhardt | 38/44 X |
| 3,849,815 | 11/1974 | Frauendorf | 68/5 C X |
| 3,961,430 | 6/1976 | Mazzolla | 38/66 |
| 4,304,053 | 12/1981 | Kellerhals et al. | 68/5 C X |
| 4,391,602 | 7/1983 | Stichnoth et al. | 68/5 D |
| 4,823,488 | 4/1989 | Fottner | 38/14 |

FOREIGN PATENT DOCUMENTS 3519568 10/1986 Fed. Rep. of Germany .

*Primary Examiner*—Andrew M. Falik
*Attorney, Agent, or Firm*—Darby & Darby

[57] ABSTRACT

A tunnel finisher for processing clothing articles that has an envelope formed of a sheet wound to a cylindrical shape in such a manner that its free longitudinal edges overlap one another. Pneumatic rollers are provided for defining an entrance or an exit of a clothing treatment space. Each roller has a shaft to which are connected discs. The envelope is secured to the discs.

6 Claims, 4 Drawing Sheets

COVER SHEET ATTACHMENT FOR A TUNNEL FINISHER PNEUMATIC ROLL

BACKGROUND OF THE INVENTION

The invention relates to a tunnel finisher.

A tunnel finisher is known from DE-PS No. 35 19 568. This known tunnel finisher has pneumatic rollers provided with a coat in the form of a cylindrical envelope. The cylindrical envelope consists of a fabric hose or of a sheet material sewed together substantially to the shape of a hose, and is secured to the discs by means of annular springs received in annular grooves of the top and bottom discs. In order to enable such a closed cylindrical envelope to be replaced, the shaft is divisible between the two discs. To this purpose each disc carries a stub shaft directed towards the other disc, the two stub shafts being adapted to be interconnected by means of a tubular member. For replacing the envelope, one of the annular springs is released, permitting the envelope to be shifted to a position for giving access to the tubular member. The threaded connections between the tubular member and the two stub shafts are then released, so that the tubular member can be slipped completely onto one of the stub shafts. This exposes the free end of the other stub shaft, so that the envelope can be pulled out through the thus formed gap after the second annular spring has been released. This procedure is obviously rather complicated, because it requires the cylindrical envelope to be compressed to a reduced length for giving access to the threaded shaft connections. This process is additionally complicated by the fact that the replacement of the envelope has to be carried out in the known tunnel finishers with the pneumatic rollers mounted in position, some of these positions within the tunnel finisher being rather difficult to gain access to. It is also difficult to keep the tubular shaft member in the raised position for dividing the shaft and at the same time to remove the envelope. Similar difficulties are encountered when mounting a new envelope.

It is also known to provide the envelopes of tunnel finishers with zip fasteners for at least marginally facilitating the replacement of the envelopes within the tunnel finisher. The zip fasteners employed for this purpose are rather expensive, however. In addition it is scarcely avoidable that a moisture condensate is formed on the metal parts of the zip fasteners.

SUMMARY OF THE INVENTION

It is therefore an object of the invention to provide an envelope for the pneumatic rollers of a tunnel finisher, which is readily replaceable while being inexpensive as well.

It has been unexpectedly found that the envelope constructed in accordance with the invention does not in any manner impair the proper function of the pneumatic rollers. Because of the omission of a fastener the preparation of the envelope is uncomplicated and inexpensive. In addition, the replacement of the envelope within the tunnel finisher is facilitated even at rather unaccessible positions.

When the overlap portion extends substantially about half, the circumference of the cylindrical shape the envelope is reliably prevented from gaping or opening under the influence of the outwards directed air flow therethrough.

A gaping or opening of the envelope may additionally be prevented by the provision that the outer longitudinal edge is tensioned in the longitudinal direction.

This tensioning effect may be brought about in a simple and inexpensive manner by securing a resilient ribbon to the exterior longitudinal edge.

An embodiment of the invention is effective to prevent the exterior longitudinal edge from getting caught by the clothing articles passing between the pneumatic rollers.

A further embodiment provides a particularly simple solution for keeping the longitudinal edge under tension.

An embodiment of the invention shall now be described by way of example with reference to the accompanying drawings, wherein:

DESCRIPTION OF THE PREFERRED EMBODIMENT

Figure 1:
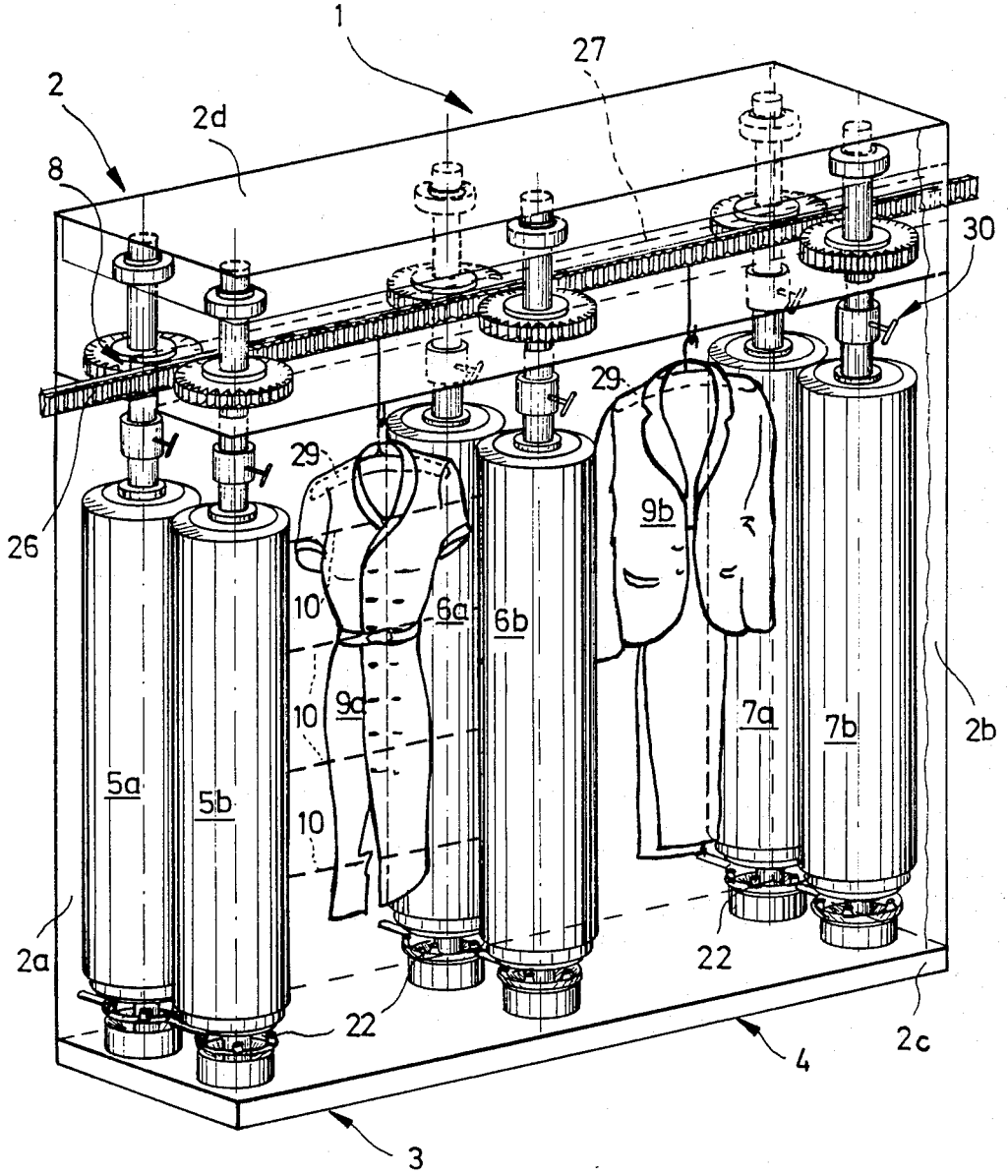
FIG. 1 shows a perspective view of a tunnel finisher.

FIG. 1 shows a tunnel finisher 1 for processing clothing articles with the purpose of removing creases therefrom. Tunnel finisher 1 has a housing 2 defined by sidewalls 2*a* and 2*b*, a bottom plate 2*c* and a top wall 2*d*. Disposed behind one another within housing 2 are two chambers 3 and 4 the ends of which are defined by respective pairs of opposing pneumatic rollers 5*a*,5*b*; 6*a*,6*b*; 7*a*,7*b* to thereby define two substantially enclosed spaces. The pneumatic rollers are rotatably mounted in the housing with their longitudinal axes vertical, and adapted to be rotated by means of a drive transmission mechanism 8 operable to rotate pneumatic rollers 5*a*,6*a* and 7*a* adjacent sidewall 2*a* in the counterclockwise direction, and rollers 5*b*,6*b* and 7*b* adjacent sidewall 2*b* in the clockwise direction. Chamber 3 is provided with a steam injection device 10 comprising steam nozzles (not shown) for the steam treatment of both sides of a clothing article 9*a*. Steam injection device 10 is connected to a steam generator (not shown) through suitable tubings. For the subsequent drying and smoothing of the clothing articles, chamber 4 is provided with a fan (not shown) operable to aspirate air from the environment, to heat it and to blow it through chamber 4 in the vertical direction.

Figure 2:
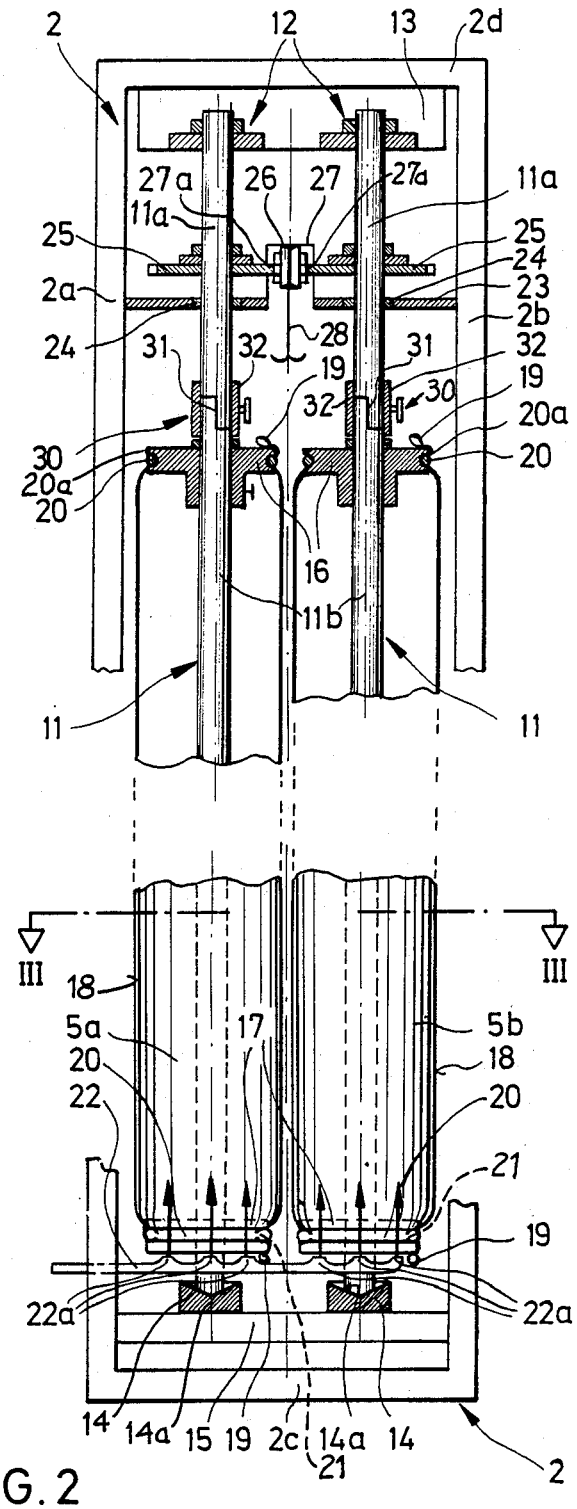
FIG. 2 shows a front view of the tunnel finisher with two pneumatic rollers positioned opposite one another.
Figure 3:
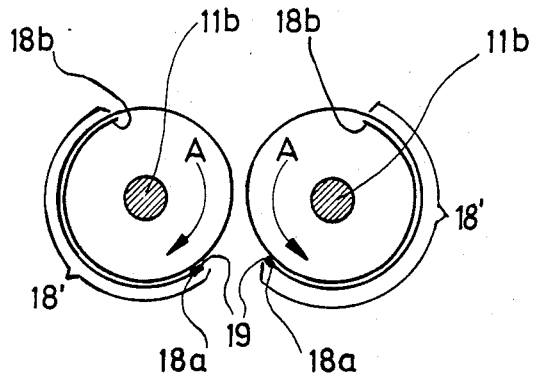
FIG. 3 shows a diagrammatic sectional view taken along the section line III—III in FIG. 2.

The pneumatic rollers are shown in greater detail in FIGS. 2 and 3. Each pneumtic roller, for instance roller 5*a*, 5*b* in FIG. 2, has a vertical shaft 11 having its upper end mounted in a bearing 12 secured to a top wall support 13 connected to top wall 2*d*. The lower end of shaft 11 is supported in a tilt bearing 14 seated on a mounting plate 15. Shaft 11 is of two-piece construction, with an upper section 11*a* mounted in bearing 12 and a lower section 11*b* supported by tilt bearing 14. Adjacent its upper end, lower section 11*b* carries a top-side disc 16, and adjacent its lower end, a bottom-side disc 17, disc 16 being releasably secured to section 11*b*, while disc 17 is fixedly secured thereto. The cylindrical space extending between the two discs is surrounded by an envelope 18.

Bottom-side disc 17 is formed with a peripherally extending slot opening 21 through which the interior of the pneumatic roller communicates with atmosphere. Disposed below the peripherally extending slot opening 21 and above tilt bearing 14 is a radially extending compressed-air pipe 22 connected to a compressor (not shown) installed outside of housing 2. Compressed-air pipe 22 is formed with nozzle-shaped openings 22*a* directed towards the peripherally extending slot opening. As shown in FIG. 2, the nozzle-shaped openings 22*a* and the peripherally extending slot openings 21 include an angle of 90° between themselves, so that the compressed air enters the pneumatic roller through opening 21 in a uniform distribution. The lower end of shaft 11 is formed as a pointed tip. Complementary thereto, tilt bearing 14 is formed with a conical recess 14*a*, so that the pneumatic roller will automatically assume its correct position in the tilt bearing and is safely retained therein by its own weight. While the upper end portion of upper shaft section 11*a* is retained in bearing 12, its lower end portion is supported by a mounting plate 23 secured to sidewalls 2*a* and 2*b*. A friction bearing 24 is installed between mounting plate 23 and shaft section 11*a*. Mounted between bearings 12 and 24 is a drive transmission wheel, preferably a sprocket wheel fixedly secured to upper shaft section 11*a* in such a manner that the sprockets 25 of the two opposite pneumatic rollers of each pair are engageable with a chain 26 passing therebetween. The teeth of sprockets 25 thus come into simultaneous engagement with chain 26. Chain 26 is surrounded on three sides by a protection rail 27 secured to mounting plate 23 and formed with longitudinally extendng slots 27*a* at the locations of sprockets 25 engaging chain 26. Secured to chain 26 at selected spacing are downwards projecting clothes hooks 28 from which clothing articles 9*a*, 9*b* are suspended by means of coat hangers 29 (FIG. 1). As shown in FIG. 1, chain 26 and protection rail 27 extend in the longitudinal direction of tunnel finisher 1 in the upper part of housing 2 through both chambers 3 and 4 for conveying clothing articles 9*a*, 9*b* through tunnel finisher 1.

Upper shaft section 11*a* is releasably connected to lower section 11*b* by a coupling device 30. As shown in FIG. 2, coupling device 30 consists of a Z-shaped joint 31 and a clamp sleeve 32. For forming Z-shaped joint 31, the lower end of upper shaft section 11*a* presents a shoulder of a radial depth substantially corresponding to half its diameter, followed by a axially extending planar surface. The upper end portion of lower shaft section 11*b* is formed with a similar shoulder and axially extending surface. In the jined state the shape of shaft sections 11*a* and 11*b* thus corresponds to that of a continuous shaft 11. This joint configuration is highly effective for transmitting a driving torque. The Z-shaped joint 31 is completely covered by clamp sleeve 32 slidably mounted on shaft 11.

As shown in FIG. 3, envelope 18 is formed of a by a substantially rectangular, planar sheet that was spirally wound around shaft section 11*b*. The exterior exposed longitudinal edge 18*a* of the sheet forms an overlap portion 18' with the interior free edge thereof. The overlap portion 18' preferably extends approximately about half the circumference of the cylindrical shape, although it may also be greater or slightly smaller. Envelope 18 is wound in such a manner that the exposed free longitudinal edge 18*a* is the trailing edge with respect to inner longitudinal edge 18*b* in the direction of rotation A of the pneumatic roller.

Figure 3A:
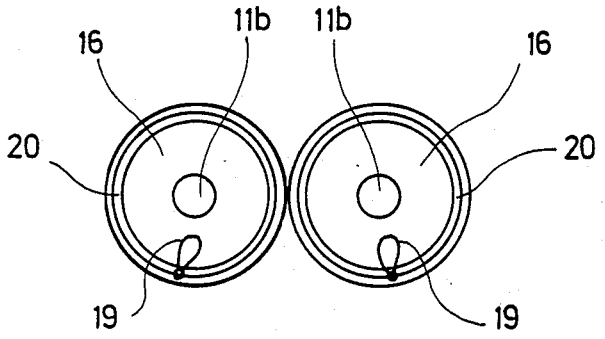
FIG. 3A shows a view similar to FIG. 3, directed, however, onto one of the end faces of the pneumatic rollers.

As shown in FIGS. 3 and 3A, the outer free longitudinal edge 18*a* is connected to an elastic ribbon 19. The elastic ribbon 19 may for instance be a cord of silicone rubber having a diameter of 4 mm. The elastic ribbon projects beyond both sides of the outer longitudinal edge 18*a*, so that it can be secured to the discs and/or to the shaft sections in a tensioned state. In this manner the elastic ribbon keeps the longitudinal edge 18*a* under tension to thereby prevent it from being caught by the passing clothing articles.

As shown in FIG. 2, envelope 18 is secured to discs 16 and 17 by means of respective clamp rings 20. Each clamp ring 20 is received in a correspondingly shaped groove 20*a* formed in the respective disc. The envelope may also, however, be secured in any other suitable manner.

Figure 4:
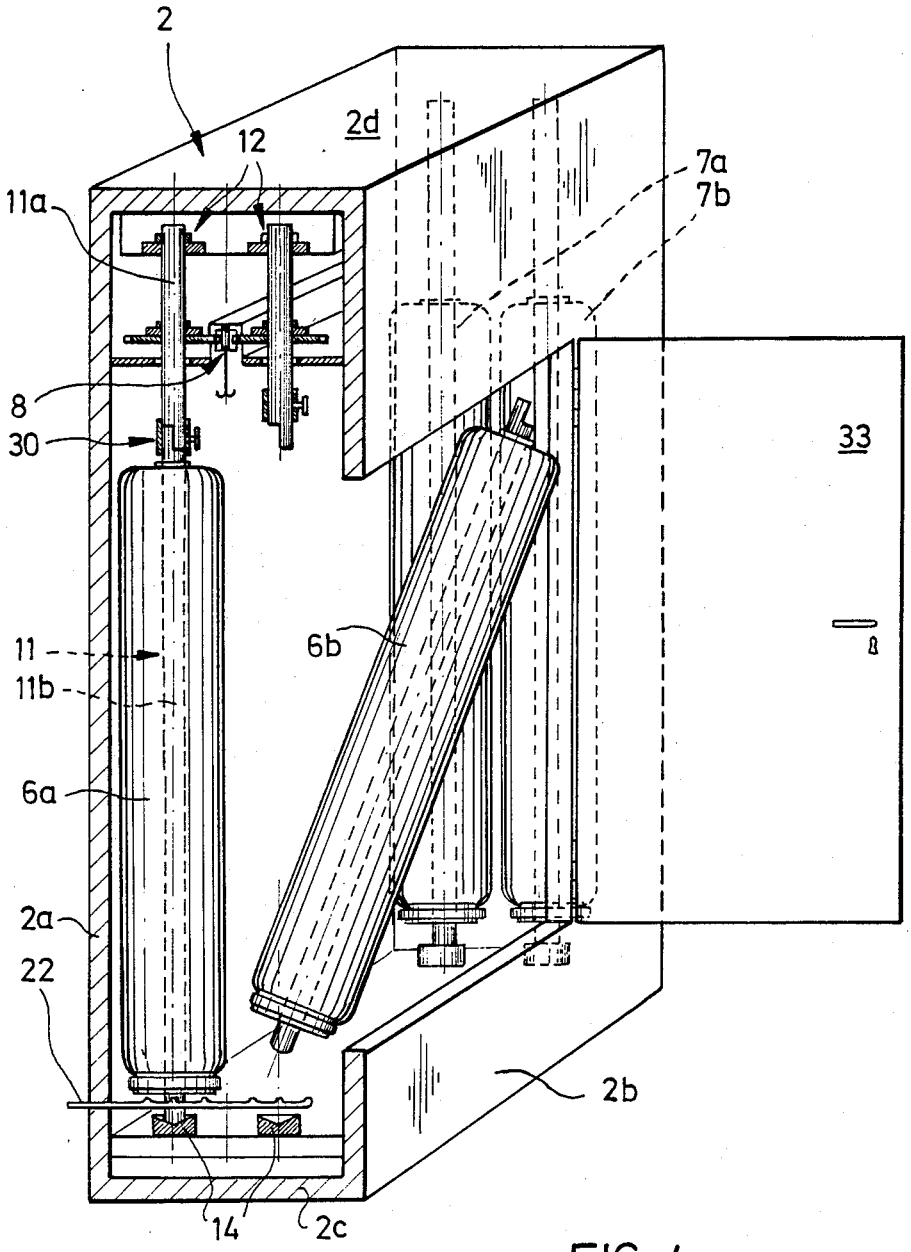
FIG. 4 shows a perspective view, partially in section, of the tunnel finisher as one of the pneumatic rollers is being dismounted.

As shown in FIG. 4, at least one sidewall 2*a* or 2*b* of housing 2 is provided with a door 33 giving access to the interior of tunnel finisher 1 for repair or maintenance operations, and particularly for dismounting pneumatic rollers 6*a* and 6*b*.

The operation of the tunnel finisher described above, and the dismounting of a pneumatic roller shall now be explained in detail.

Compressed air supplied via compressed-air pipe 22 and its nozzle-shaped openings 21 is injected through the peripherally extending slot openings in the bottom-side discs 17, so that envelope 18 is inflated to a cylindrical shape and the pneumatic rollers of each pair come into contact with one another. The coat hangers carrying clothing articles are suspended from clothes hooks 28 and conveyed by chain 26 towards the first roller pair 5*a*,5*b* and through the gap therebetween into the first chamber 3 of the tunnel finisher. Since the envelope of each pneumatic roller yields to pressure, the passage of the clothing articles between the rollers does not result in the formation of creases. As soon as a clothng article has entered the first chamber 3, steam injection device 10 is operated. In this manner the clothing article is subjected to a steam treatment from at least two sides, whereby the fabric is caused to relax. After the steam treatment of clothing article 9*b*, it passes from chamber 3 into chamber 4, while a second clothing article 9*a* enters chamber 3, wherein the above described procedure is repeated.

In chamber 4 the clothing article 9*b* is subjected to the action of heated air for drying and smoothing it, so that the clothing article is free of creases on leaving chamber 4.

The treatment carried out in chamber 4 is then repeated for the second clothing article. The dwell time in the steam and air treatment chambers may be controlled by selecting a suitable chain speed. Since the pressurized pneumatic rollers of each pair are in peripheral contact with one another the chambers are effectively isolated from each other and from the environment.

For the replacement of an envelope the respective pneumatic roller is preferably dismounted from the tunnel finisher. To this purpose the pneumatic rollers are accessible from the front or the rear of the housing or through the door 33 provided in at least one of the sidewalls. At first the supply of compressed air to the bottom sides of the pneumatic rollers is interrupted. The clamp sleeve is then unclamped and displaced along shaft 11, in FIG. 4 upwards, to be again clamped in the displaced position. The shaft can now be divided into an upper section 11*a* remaining in the tunnel finisher and a lower section 11*b* to be dismounted. To this purpose lower section 11*b* is displaced in a radial direction to thereby disengage the shoulders of the Z-shaped joint from one another. The lower shaft section can then be tilted in its tilt bearing and lifted out of the respective chamber together with its envelope. The envelope is removed by dismounting the clamp rings retaining it on the bottom-side and top-side discs, and by releasing the elastic ribbon. The envelope may then be readily unwound and replaced.

The envelope according to the invention may of course not only be employed in a tunnel finisher having dismountable pneumatic rollers. The envelope according to the invention is in fact also suitable for use in tunnel finishers in which the envelope has to be replaced while the pneumatic rollers are in their operating positions or in any other position within the tunnel finisher.

In a modification of the embodiment described and illustrated by way of an example, the elastic ribbon may be omitted, the outer longitudinal edge of the envelope being put under tension during installation. Likewise, the sheet material envelope may be secured to the discs in any other suitable manner. In another modification of the described embodiment, the axially displaceable clamp sleeve may be replaced by a separable clamp sleeve composed of two semicircular sections. This would permit the overall height of the tunnel finisher to be reduced to a considerable degree. Other coupling devices could be employed for interconnecting the shaft sections. The upper shaft section could thus have a quadrangular lower end portion to be received in a correspondingly shaped socket in the upper end portion of the lower shaft section, in which case the clamp sleeve could be omitted, and the tilt bearing would have to be axially displaceable for permitting the connection to be separated. The tilt bearing could also be of conical shape with an upwards directed point, in which case the lower shaft section would have a conical recess in its lower end. The arrangement of the nozzle-shaped openings of the compressed-air pipe could be varied to any suitable position below the peripherally extending slot opening of the bottom-side disc.

What is claimed is:

1. A tunnel finisher comprising pneumatic rollers for defining an entrance or an exit, respectively, of a clothing treatment space, each pneumatic roller comprising a shaft having ends supported by a bearing secured to a housing, bottom-and-top-side discs connected to said shaft, and an envelope secured to said discs, said envelope enveloping a hollow cylindrical interior room extending between said discs, said envelope being adapted to be supplied with compressed air, said envelope being formed of a sheet in the form of a cylinder so as to form an overlap portion between exterior and interior positioned free longitudinal edges of said sheet said exterior positioned free longitudinal edge being positioned exteriorly of said envelope and said interior positioned free longitudinal edge having positioned within said interior room.

2. A tunnel finisher according to claim 1, characterized in that said overlap portion extends approximately about half the circumference of said cylindrical shape.

3. A tunnel finisher according to claim 1, further comprising means for tensioning the exterior positioned longitudinal edge in the longitudinal direction.

4. A tunnel finisher according to claim 3, characterized in that said exterior positioned longitudinal edge is connected to a resilient ribbon the ends of which are secured to said discs or said shaft, respectively.

5. A tunnel finisher according to claim 1, characterized in that said exterior positioned longitudinal edge is the trailing edge relative to the interior longitudinal edge in the direction of a rotation (A) of said pneumatic roller.

6. A tunnel finisher according to claim 4, characterized in that said resilient ribbon is connected to said exterior longitudinal edge in an untensioned state and projects beyond said longitudinal edge on both sides.

* * * * *